US007108341B2

(12) United States Patent
Myers et al.

(10) Patent No.: US 7,108,341 B2
(45) Date of Patent: Sep. 19, 2006

(54) REFRIGERATOR CABINET ASSEMBLY

(75) Inventors: John Phillip Myers, Galesburg, IL (US); Douglas A. Pohl, Davenport, IA (US); Richard D. Smith, Jr., Coal Valley, IL (US)

(73) Assignee: Maytag Corporation, Newton, IA (US)

( * ) Notice: Subject to any disclaimer, the term of this patent is extended or adjusted under 35 U.S.C. 154(b) by 315 days.

(21) Appl. No.: 10/624,545

(22) Filed: Jul. 23, 2003

(65) Prior Publication Data

US 2005/0017618 A1 Jan. 27, 2005

(51) Int. Cl.
*A47B 96/00* (2006.01)

(52) U.S. Cl. ..... 312/352; 312/406.2

(58) Field of Classification Search ..... 29/455.1, 29/505, 449; 312/401, 405, 406, 407, 406.2, 312/352; 62/440
See application file for complete search history.

(56) References Cited

U.S. PATENT DOCUMENTS

| | | | | |
|---|---|---|---|---|
| 3,948,410 | A | 4/1976 | Anderson | |
| 4,080,021 | A | 3/1978 | Pringle | |
| 4,348,068 | A | 9/1982 | Hawkins et al. | |
| 4,550,576 | A | 11/1985 | Tate, Jr. et al. | |
| 4,558,503 | A | 12/1985 | Wilson | |
| 4,577,915 | A | 3/1986 | Nishida et al. | |
| 4,632,470 | A | 12/1986 | Jenkins et al. | |
| 4,732,432 | A * | 3/1988 | Keil et al. | 312/406.2 |
| 4,821,399 | A * | 4/1989 | Markley et al. | 29/458 |
| 4,822,117 | A | 4/1989 | Boston, Jr. | |
| 4,955,676 | A * | 9/1990 | Weaver et al. | 312/407 |
| 4,958,890 | A | 9/1990 | Anderson et al. | |
| 4,974,914 | A | 12/1990 | Jenkins | |
| 5,584,551 | A * | 12/1996 | Jenkins | 312/401 |
| 5,720,536 | A * | 2/1998 | Jenkins et al. | 312/406.2 |
| 5,897,181 | A | 4/1999 | Avendano et al. | |
| 5,899,546 | A | 5/1999 | Avendano et al. | |
| 6,036,293 | A | 3/2000 | Anell et al. | |
| 6,036,294 | A * | 3/2000 | Banicevic et al. | 312/407 |

FOREIGN PATENT DOCUMENTS

| | | |
|---|---|---|
| SE | 205839 | 7/1966 |

* cited by examiner

*Primary Examiner*—James O. Hansen
(74) *Attorney, Agent, or Firm*—Diederiks & Whitelaw PLC

(57) ABSTRACT

A refrigerator cabinet includes a shell having first and second laterally spaced, upstanding side walls that are interconnected by a top wall, each of the walls includes an in-turned front edge portion defining a liner receiving cavity. The shell further includes a mullion bar, which partitions the shell into first and second liner cavities, and a base member. Both the mullion bar and base member have respective liner receiving portions. With this arrangement, first and second liners are adapted to be inserted into their respective cavities and flexed such that three sides are inserted into the liner receiving cavities, while the remaining side is positioned against a land of the mullion bar or base member. Once in place, the liners are secured through a mullion bar cover and a base member cover. This construction combines the benefits of a front-load process with that of a flex-load process, lowering assembly time without the need to reinforce the liner.

12 Claims, 5 Drawing Sheets

REFRIGERATOR CABINET ASSEMBLY

BACKGROUND OF THE INVENTION

1. Field of the Invention

The present invention pertains to the art of refrigerators and, more particularly, to the structure and assembly of a refrigerator cabinet.

2. Discussion of the Prior Art

In general, it is known to construct a refrigerator by initially forming a shell and then inserting a liner portion therein. The prior art teaches a variety of methods for engaging the liner portion with the shell. These methods can be best described as slide-in, front-load, flex-load and combinations thereof.

In connection with a top mount refrigerator, the slide-in method initially positions the shell in a matter that provides access to a bottom portion. The liner portion is then inserted through the bottom portion and into place within the shell, thus forming a freezer compartment. Typically in top mount refrigerators, at this point, a mullion member is positioned such that the shell is partitioned into upper and lower cavities. After the mullion member is secured, a second liner is inserted through the bottom portion to form a fresh food compartment. While this method has proven effective over the years, it generally requires more production space due to the overall size of the refrigerator and the need to position the unit providing access to the bottom.

Another known manufacturing process is the front load method. Using this process, a shell is constructed having a flange extending about a periphery of the shell which forms a receiving cavity opening towards a front of the refrigerator shell. A liner, having an outwardly extending projecting edge portion leading to an in-turned rim portion, is then inserted into the shell wherein the in-turned rim portion is positioned in the receiving cavity to position the liner in place. At this point, a plurality of trim pieces are secured to the shell such that the liner is held in place for the next processing step. While also an effective method, the need for the trim pieces adds to the overall cost of production.

A variation of the front-load method, the flex-load process, eliminates the need for the additional trim pieces required to hold the liner in place. Using this process, a shell is constructed having an in-turned flange leading to a return flange which collectively define a laterally opening receiving cavity. In contrast to the front-load liner, the flex-load liner includes an outwardly projecting edge. To form the cabinet, the liner is inserted into the shell, and flexed or deformed laterally inwardly to allow the projecting edge to be positioned in the receiving cavity. A drawback with this process exists in that the liner must be tough enough to flex without tearing or developing cracks. That is, the liner must be formed such that portions of the liner which undergo stress during deformation must be strengthened. Typically, a refrigerator liner is a paper thin, thermoformed plastic tub-like member. Therefore, excessive handling or deformation during construction of the cabinet can result in cracking and subsequent failure of the liner. In most cases, the failure is not realized until after insulation is added. If insulation is added to a defective or failed liner, the liner could burst thereby requiring the shell to be discarded.

Based on the above, there exists a need in the art for a method of constructing a refrigerator cabinet which combines the benefits of front-loading with those derived from flex-loading. More specifically, there exists a need for a liner adapted to flex into portions of the shell, while remaining edge portions of the liner are initially exposed and later covered by a trim piece.

SUMMARY OF THE INVENTION

The present invention is directed to a refrigerator cabinet assembly including a shell having first and second laterally spaced upstanding side walls that are interconnected by a top wall. Specifically, each of the side and top walls include front edge portions being in-turned to form respective front face portions of the shell. The front face portions lead to a return flange that defines a liner rim receiving cavity opening laterally inward of the shell.

The cabinet assembly further includes a base member interconnected with the first and second side walls and preferably forming a face plate. In addition, a mullion bar is interconnected with and secured to the side walls at a position spaced from the base member. With this arrangement the mullion bar partitions the shell into first and second liner receiving portions. In accordance with a preferred form of the invention, the mullion bar includes first and second horizontally extending shoulder portions which, in turn, define first and second liner rim receiving lands.

With this construction, first and second liners having outwardly projecting edge portions are respectively inserted into the first and second liner receiving portions. Specifically, the outwardly projecting edge portions define liner peripheral rims which are adapted to be inserted into the liner rim receiving cavities disposed about the shell. More specifically, the first liner is inserted into the first liner receiving portion establishing a freezer compartment, with the first liner being flexed so that upper and side peripheral rims are engaged with the rim receiving cavities on the shell and then released so that a bottom liner edge portion rests on the mullion bar. Similarly, the second liner is inserted into the second liner receiving portion establishing a fresh food compartment. That is, the second liner is flexed such that side edge portions engage with the liner receiving cavities on the shell and, upon being released, upper and lower edge portion of the liner rest in respective receiving portions on the mullion bar and base member.

Once the first and second liners are in place, a mullion bar cover is secured to the mullion bar such that the lower edge of the first liner and the upper edge of the second liner are held in place. The lower edge of the second liner is then covered by a base plate cover so that the second liner is held in place for subsequent manufacturing steps. Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
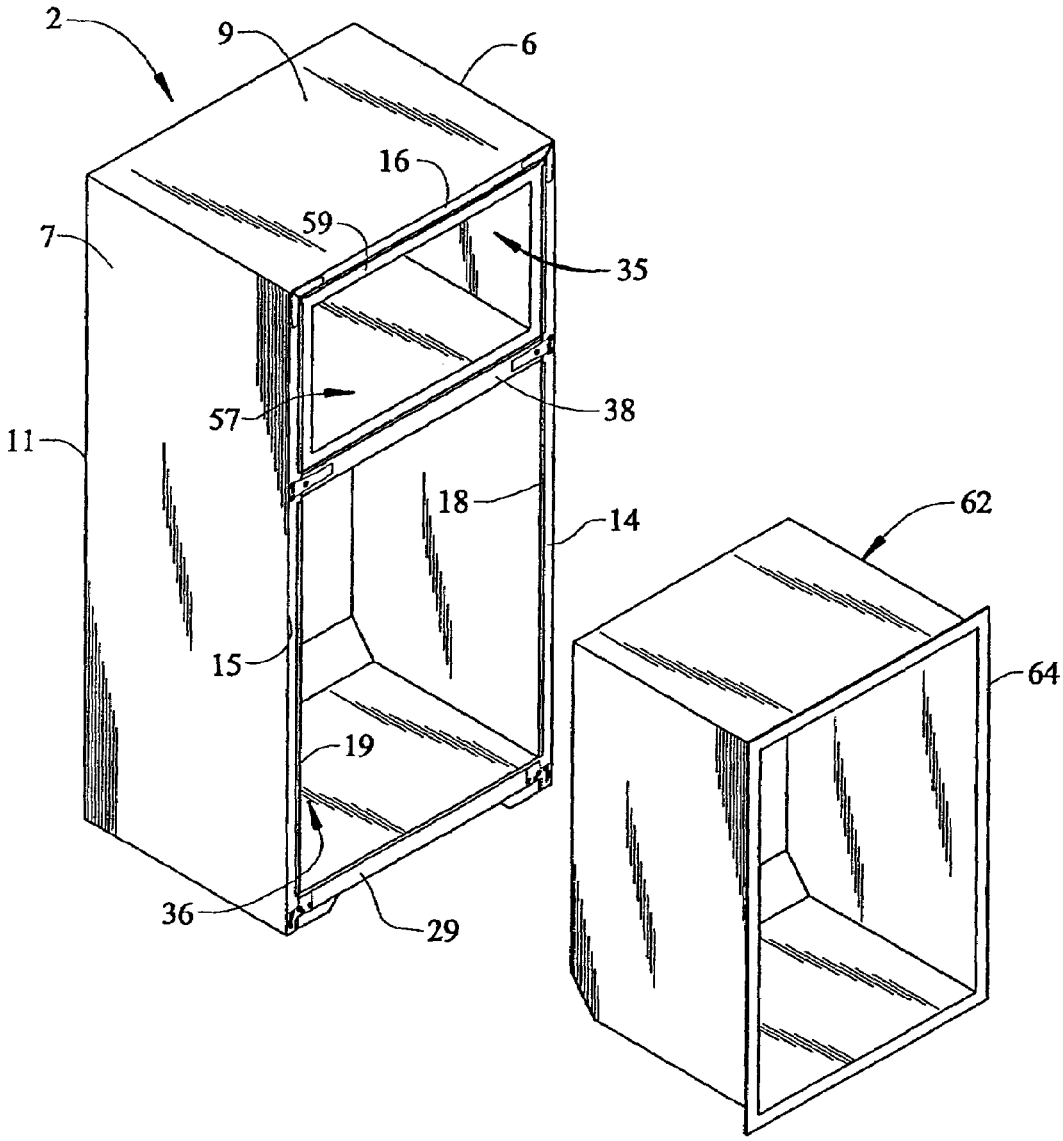
FIG. 1 is an exploded view of a top mount flex load refrigerator cabinet constructed in accordance with the present invention.
Figure 2:
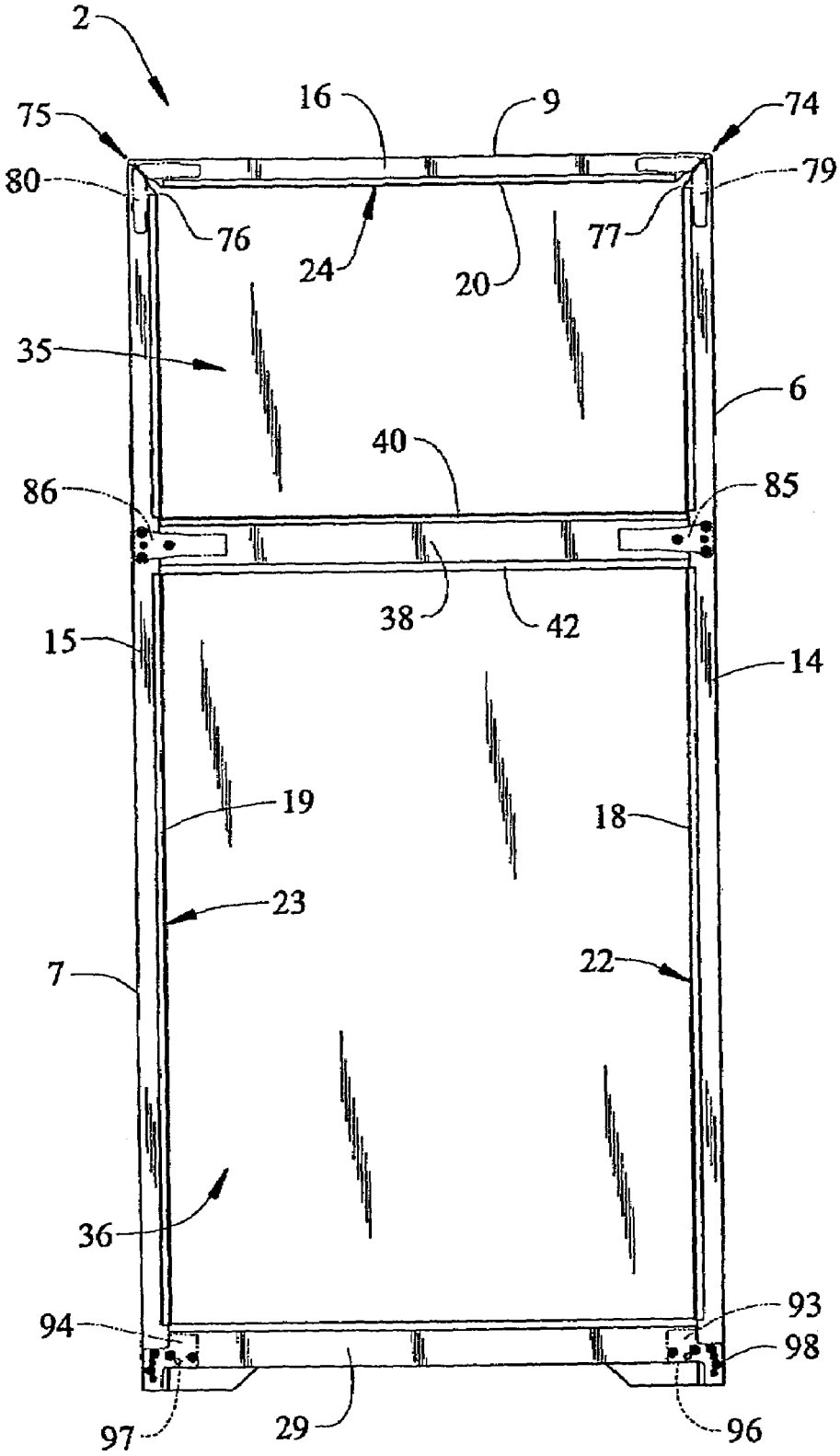
FIG. 2 is a front view of a shell of the refrigerator cabinet of the present invention.

With initial reference to FIGS. 1 and 2, a refrigerated cabinet shell constructed in accordance with the present invention is generally indicated at 2. Cabinet shell 2 includes a first side wall 6, a second side wall 7, a top wall 9, and a rear wall 11. Preferably, side walls 6 and 7 and top wall 9 are integrally formed from bending a single piece of sheet metal, with side walls 6 and 7 being arranged in an upstanding, substantially parallel manner and are interconnected by top wall 9. Rear wall 11 is also preferably formed from sheet metal and is separately secured to side walls 6 and 7, as well as top wall 9.

Figure 3:
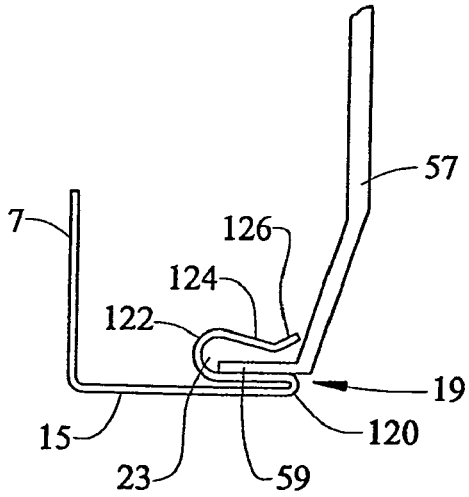
FIG. 3 is a partial cross-sectional view of a front face portion of the refrigerator of the present invention with a liner installed.

Front edge portions of each of the side walls 6 and 7 and top wall 9 are bent inwardly so as to define respective front face portions 14–16. Each of the front face portions 14–16 terminates in respective return flanges 18–20 (also see FIG. 3). Although the specific structure of return flanges 18–20 will be discussed more fully below, each return flange defines, at least in part, a respective liner receiving cavity 22–24 one of which is shown in FIG. 3. As best shown in FIG. 2, a base portion 29 interconnects lower portions of front face portions 14 and 15 of upstanding side walls 6 and 7. Preferably, base portion 29 is secured to side walls 6 and 7 using a pierce riveting process, although other methods such as spot welding, and mechanical fasteners are equally acceptable. As will be described more fully below, base portion 29 includes an in-turned liner received ledge 30 extending horizontally along a top edge of base portion 29. A cover or kick plate 32 (FIG. 6) is further arranged over base portion 29 to act as a finish covering.

As will be explained hereinafter, shell 2 is sub-divided into upper and lower portions 35 and 36 so as to define freezer and fresh food sections. Towards that end, a mullion bar 38 interconnects side walls 6 and 7 at a defined distance from top wall 9. In a manner similar to that used to secure base portion 29, mullion bar 38 is fastened to side walls 6 and 7 using a pierce riveting process. In accordance with a preferred form of the present invention, an upper liner receiving land 40 extends horizontally across an upper edge portion of mullion bar 38. Likewise, a lower liner receiving land 42 extends horizontally across a lower edge portion of mullion bar 38. In a manner similar to base portion 29, a mullion bar cover portion 44 (FIG. 4) serves as a finish covering for mullion bar 38. Preferably, base cover 32 and mullion cover 44 are attached to base portion 29 and mullion bar 38 respectively, with adhesive. In a manner known in the art, a yoder tube 46 is arranged behind mullion bar 38. Yoder tube 46 minimizes the development of condensation by providing a minimal amount of heat which radiates through to an outer surface of mullion bar 38.

As will be set forth more fully below, the construction of cabinet shell 2 enables upper liner receiving portion 35 to receive an upper or freezer compartment liner 57. In the preferred arrangement, upper liner 57 is constructed from thermoformed plastic and includes an outwardly projecting edge portion 59. In an analogous manner, lower liner receiving portion 36 is adapted to receive a lower or fresh food compartment liner 62, which is similar in construction to freezer compartment liner 57 and includes an outwardly projecting edge portion 64.

With this arrangement, cabinet shell 2 defines upper corners 74 and 75 at the junction between respective side walls 6 and 7 and top wall 9. Each upper corner 74, 75 defines a respective slot 76, 77 at front face portions 14–16. In a preferred form of the invention, corner reinforcing braces 79 and 80 are adhesively secured to inner surfaces of upper corners 74 and 75 to provide an additional measure of structural stability to shell 2. Shell 2 further includes additional reinforcing structure in the form of mullion bar attachment brackets 85 and 86 which extend between side walls 6 and 7 and mullion bar 38, and base plate attachment brackets 93 and 94 that extends between side walls 6 and 7 and base portion 29.

In addition to securing mullion bar 38 and base portion 29, attachment brackets 85–86 and 93–94 can be used to aide in securing hinges and support legs to cabinet shell 2. Specifically, attachment brackets 85–86 and 93–94 can be used as tapping plates to secure hinge members (not shown) to accommodate associated doors (not shown). More specifically, base portion attachment brackets 93–94 include leg mounting flanges 96 and 97. In a manner known in the art, leg mounting flanges 96 and 97 include a threaded bore 98 (see FIG. 7) adapted to receive a respective leg member (not shown). Actually, a plurality of leg members extend from leg mounting flanges 96 and 97 at front and rear portions of cabinet shell 2, along side walls 6 and 7. In any event, the various leg members are preferably, vertically adjustable to also act as levelers for cabinet shell 2. Such type of leg leveler arrangements are widely known in the art of appliances, including ranges and refrigerators, such that the leveling function of the leg members does not form part of the present invention.

Reference will now be made to FIG. 3 in describing the specific structure of return flanges 18–20. Since the structure of each return flange 18–20 is identical, a detailed description of return flange 19 will be made and it is to be understood that return flanges 18 and 20 have commensurate structure. Return flange 19 includes a first section 120 that, in the preferred embodiment, is formed as an in-turned, folded back portion arranged generally parallel to face portion 15. First section 120 leads to a second section 122 that curves inward. Thereafter, second section 122 leads to a third or return section 124. Collectively, this structure defines liner receiving cavity 23. A fourth, angled section 126 extends from third section 124 which, as will be described more fully below, enhances the insertion of a respective liner edge portion 59 or 64.

Figure 4:
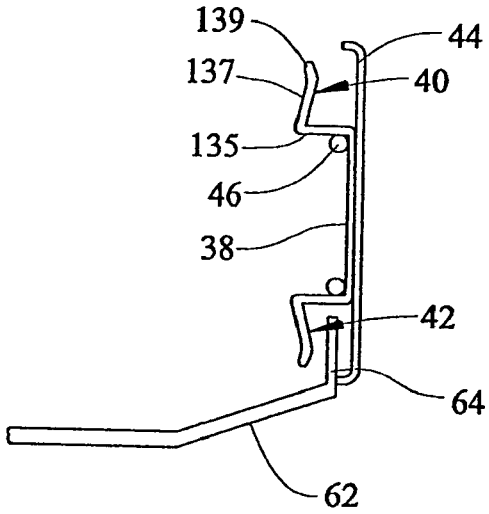
FIG. 4 is a partial cross-sectional view of a mullion bar of the refrigerator of FIG. 2 depicting a lower liner installed.

Reference will now be made to FIG. 4 in describing the specific structure of liner receiving lands 40 and 42 arranged along mullion bar 38. Since the structure of each liner receiving land is identical, a detailed description of receiving land 40 will be made and it is to be understood that receiving land 41 has commensurate structure. In accordance with a preferred embodiment, receiving land 40 includes a first segment 135 extending inwardly towards rear wall 11, generally perpendicular to the main body (not separately labeled) of mullion bar 38. First segment 135 leads to a second, angled segment 137 which, in turn, leads to a third, preferably tapered and angled segment 139.

Figure 5:
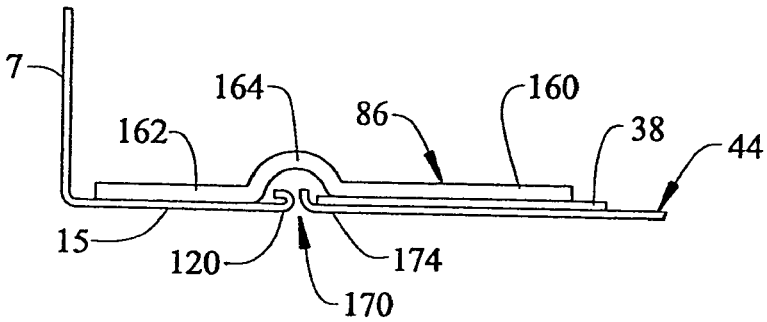
FIG. 5 is a partial top view of a corner of the mullion bar of FIG. 4, depicting a hinge tapping plate interconnecting the mullion bar to the refrigerator cabinet.

In accordance with one preferred embodiment of the present invention, mullion bar 38 extends laterally across cabinet shell 4 and interconnects side walls 6 and 7 through mullion brackets 85 and 86. As each connection between mullion bar 38 and brackets 85 and 86 is identical, a detailed description of the connection formed by bracket 86 will be described. As best shown in FIG. 5, mullion bracket 86 includes a first portion 160 secured to mullion bar 38 and a second portion 162 secured to a rear surface of front face portion 15. In a preferred arrangement, mullion bar 38 is secured to brackets 85 and 86 with a pierce riveting process, and likewise brackets 85 and 86 to front face portions 15 and 16. While pierce riveting is disclosed as the preferred method of attachment, it should be understood that other methods, such as welding or the use of mechanical fasteners, are equally acceptable.

Preferably, first and second portions 160 and 162 are interconnected through a curved portion 164 which spans a gap 170 arranged between mullion bar 38 and face portion 15. In order to provide a flat surface, so that mullion bracket 86 will lie flush against an inner surface of face portion 15, return flange 19 is interrupted at the mullion bar attachment point. More specifically, return flange 19 terminates at first section 120. At this point, mullion bar 38 is secured to bracket 86, spaced from face portion 15. With this arrangement, gap 170 provides clearance to receive an in-turned terminated portion 174 of mullion cover 44.

Figure 6:
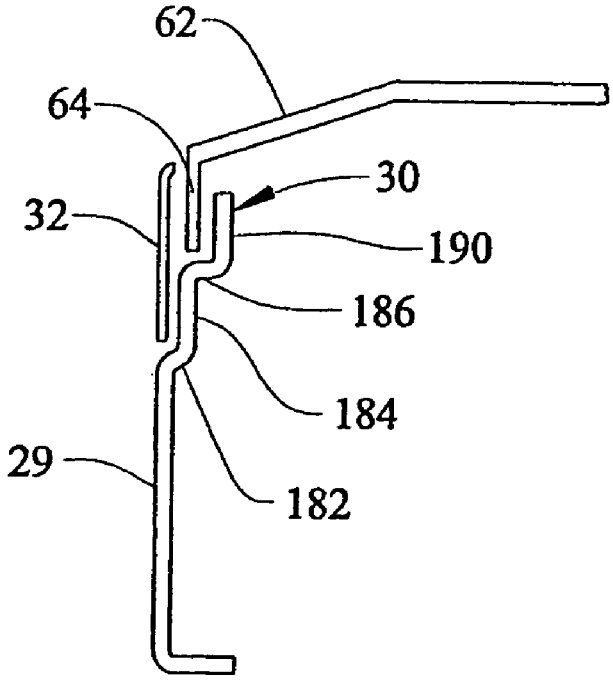
FIG. 6 is a partial cross-sectional view of the base portion of FIG. 1 depicting the lower liner arranged in a receiving land.

Reference will now be made to FIG. 6 in describing a preferred arrangement of liner receiving ledge 30 which extends along the upper edge of base portion 29. As shown, liner receiving ledge 30 includes a first, in-turned section 182 extending from base portion 29 leading to a second section 184 which extends vertically, substantially parallel to base portion 29. A third section 186 of receiving ledge 30 extends from second section 184 curving and extending inward of cabinet shell 2. Third section 186 leads to a fourth section 190 that extends vertically, substantially parallel to base portion 29. With this arrangement, liner receiving ledge 30 appears as a series of steps extending from base portion 29 and providing at least one surface (not separately labeled) onto which projecting rim 64 of liner 62 can rest.

Figure 7:
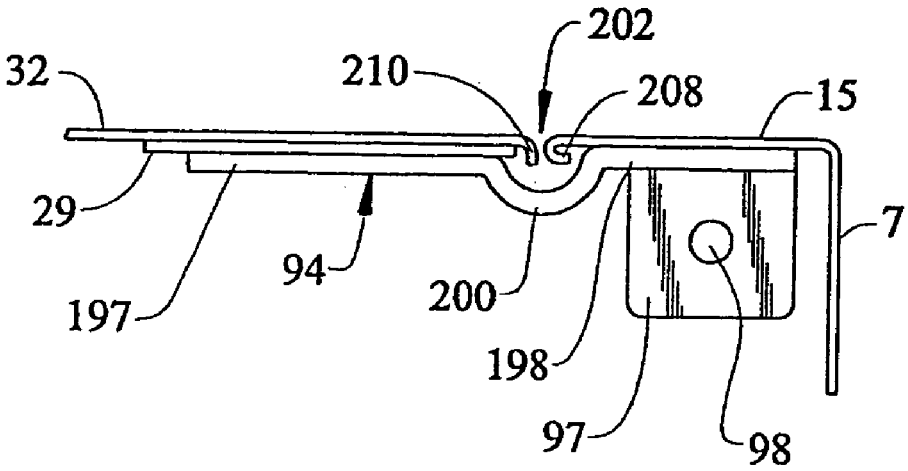
FIG. 7 is a partial bottom view of the base portion of FIG. 6, depicting a hinge tapping plate interconnecting the base portion to the cabinet.

In a manner similar to that described above with respect to mullion bar 38, base portion 29 extends laterally across and interconnects side walls 6 and 7 through respective base portion brackets 93 and 94. As each connection between base portion 29 and brackets 93 and 94 is identical, a detailed description of the connection formed by bracket 94 will be described. As best shown in FIG. 7, base portion bracket 94 includes a first portion 197 which is secured to base portion 29 and a second portion 198 secured to a rear surface of front face portion 15. Preferably, first and second portions 197 and 198 are interconnected through a curved portion 200 which spans a gap 202 established between base portion 29 and front face portion 15.

In a preferred form of the invention, as described above, leg mounting section 97 extends from second portion 198, thus providing the necessary support for legs (not shown). Likewise, in a manner similar to that described above with respect to mullion bar 38, in order to provide a flat surface so that base portion attachment bracket 94 can lie flush against an inner surface of front face portion 15, return flange 19 is interrupted at the base portion attachment point. More specifically, return flange 19 terminates at first section 208. Base portion 29 is then secured to bracket 94, spaced from front face portion 15. With this arrangement, gap 202 provides clearance to receive an in-turned terminal portion 210 of base cover 32.

The above described construction allows first and second liners 57 and 62 to be advantageously inserted into respective first and second liner receiving portions 35 and 36. In accordance with the most preferred embodiment of the invention, first liner 57 is initially placed in first liner receiving portion 35. At this point, first liner 57 is flexed such that top and side portions of projecting rim 59 engage the respective liner receiving cavities 22–24. Once each of the respective top and side portions have engaged a respective receiving cavity 22–24, first liner 57 is released such that bottom edge portion of projecting rim 57 rests in upper liner receiving land 40 extending across mullion bar 38.

In a similar manner, second liner 62 is inserted into second liner receiving portion 36 and flexed such that each respective side portion of projecting rim 64 engages respective liner receiving cavities 22 and 23 extending along side walls 6 and 7. Second liner 62 is then released such that upper edge of projecting rim 64 comes to rest against lower liner receiving land 42 (FIG. 4), and the lower edge of projecting rim 64 rests upon liner receiving ledge 30 (FIG. 6). In this manner, first and second liners 57 and 62 can be constructed in a manner which eliminates the need for reinforcing particular areas of the liners in order to accommodate the stresses caused by flexing the liners to place the peripheral rim portions thereof into the respective receiving cavities. Once each of the first and second liners 57 and 62 are so positioned, mullion cover 44 and base cover 32 are secured to mullion bar 38 and base portion 29 respectively. Preferably, mullion cover 44 and base cover 32 are secured with adhesive, however other means, such as double-sided tape and the like, are also acceptable. Finally, while significant gaps are depicted between mullion cover 44, base cover 32, and the respective projecting rims 59 and 64 for clarity purposes, actually these components are essentially in abutting relationship prior to an injection foaming process.

The above described embodiment is considered to be generally designed for light-duty applications, e.g. refrigerators under 20 cubic feet in size, wherein extra horizontal stability is not generally required. In heavier duty applications, e.g. for larger units having storage on the doors and the like, reinforcing structure is preferably added to mullion bar 38 and base portion 29.

Figure 8:
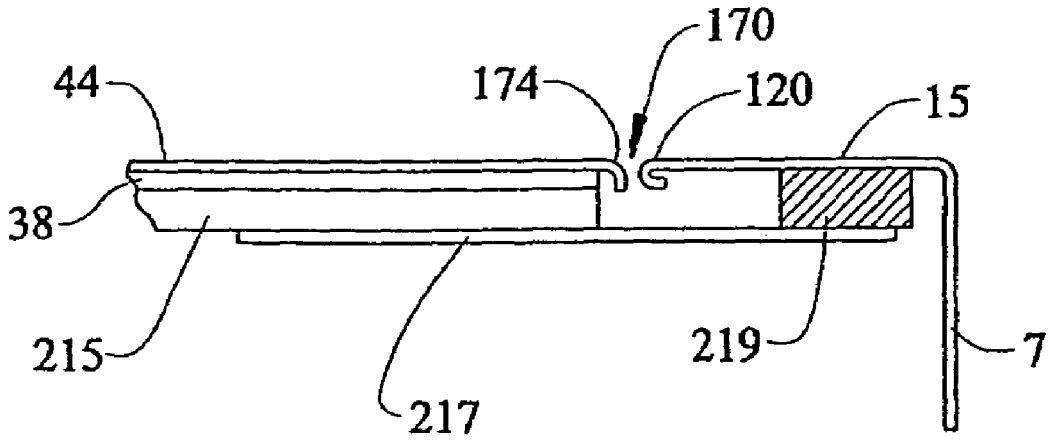
FIG. 8 is a partial top view of a reinforced mullion bar arrangement constructed in accordance with a preferred embodiment of the present invention.

Now referring to FIG. 8 depicting another embodiment of the present invention, a mullion reinforcing cross-brace 215 is secured to mullion bar 38. Mullion bar reinforcing cross-brace 215 increases the stiffness and, by extension, the horizontal stability of cabinet shell 2 to accommodate, in part, larger doors having extensive storage space. Preferably, cross-brace 215 is secured to front face portion 15 of side wall 7 through a bridge element 217. Since cross-brace 215 increases the thickness of mullion bar 38, a spacer element 219 is secured to front face portion 15 providing an attachment point for bridge element 217. In a preferred form of the invention, cross-brace 215 is secured to bridge element 217 with a pierce riveting process. Likewise, bridge element 217 and spacer element 219 are secured to front face portion 15 through a similar process. However, as with brackets 85 and 86 and 93 and 94, other attachment methods, such as welding and the use of mechanical fasteners, are equally acceptable.

Figure 9:
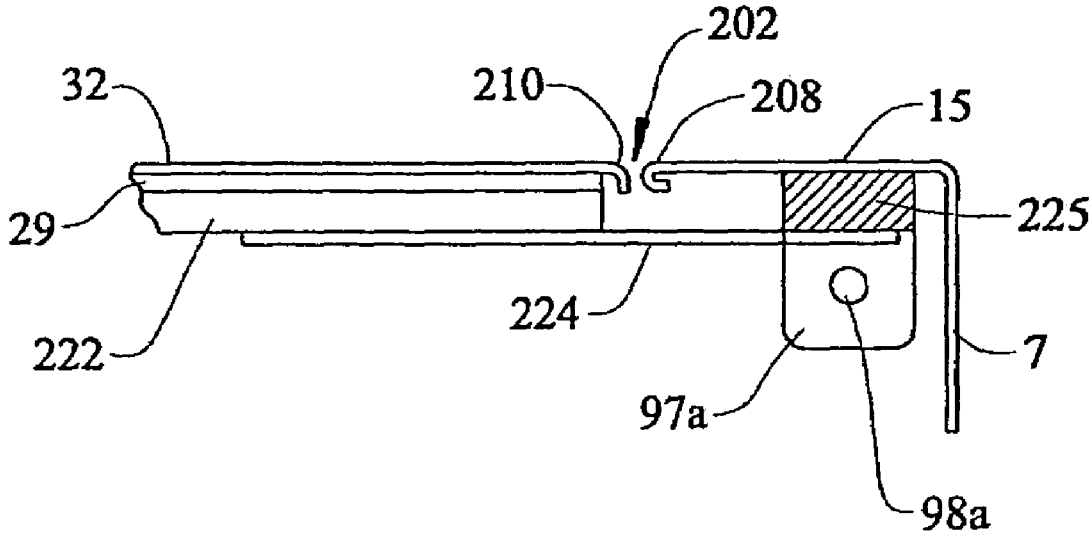
FIG. 9 is a partial bottom view of a reinforced base portion arrangement employed in the embodiment of FIG. 8.

In order to further strengthen cabinet shell 2, a similar stiffener arrangement is also incorporated into base portion 29. As best seen in FIG. 9, a base portion reinforcing brace 222 is secured to base portion 29. In a manner similar to that described above, base portion reinforcing brace 222 increases the horizontal stability of shell 2. Base portion reinforcing brace 222 is secured to front face portion 15 through a bridge element 224 and associated spacer element 225. More specifically, bridge element 224 included a leg mount 97*a* having an associated threaded bore 98*a* adapted to interconnect with an associated leg member (not shown). Using a process similar to that set forth above, base portion reinforcing brace 222 is secured to base portion 29 through a pierce riveting process. Likewise, bridge element 224 and spacer 225 are attached to front face portion 15 in the same manner. It should be understood that, having described the particular reinforcing elements and attachment thereof to front face portion 15, identical structure and processes are used to secure corresponding reinforcing elements to opposing front face portion 14.

Although described with reference to preferred embodiments of the invention, it should be readily understood that various changes and/or modifications can be made to the invention without departing from the spirit thereof. For instance, the particular method of attachment of mullion cover and base cover can be varied without departing from the spirit of the invention. Additionally, although shown and described with reference to a top mount refrigerator, a similar structure and method can be used to assemble a side-by-side unit. In general, the invention is only intended to be limited by the scope of the following claims.

We claim:

1. A method of assembling a refrigerator cabinet including a shell having first and second laterally spaced upstanding side walls interconnected by a top wall with each of the top and side walls including an in-turned flange that defines respective liner receiving cavities comprising:

attaching a base member between the upstanding side walls;

mounting a mullion bar to divide the shell into first and second liner receiving portions;

flex loading a first liner having a plurality of peripheral rim portions that define a corresponding plurality of outwardly projecting edge portions such that at least two sides of the first liner are flexed to enable at least two of the plurality of outwardly projecting edge portions to be received into respective ones of the liner receiving cavities, while another one of the plurality of peripheral rim portions extends along a first mullion land;

flex loading a second liner having a plurality of peripheral rim portions that define a corresponding plurality of outwardly projecting edge portions such that at least two sides of the second liner are flexed to enable at least two of the plurality of outwardly projecting edge portions to be received into respective ones of the liner receiving cavities, while another one of the peripheral rim portions extends along a second mullion land; and mounting a mullion cover such that a portion of the mullion cover extends over the first and second mullion lands and the another ones of the peripheral rim portions.

2. The method of claim 1, further comprising: mounting the mullion bar to the shell through a pair of attachment brackets.

3. The method of claim 2, further comprising: creating a gap between the shell and the mullion bar and positioning at least one end portion of the mullion cover therein.

4. The method of claim 2, further comprising: reinforcing the mullion bar with a reinforcing brace secured to a rear surface portion of the mullion bar.

5. The method of claim 1, further comprising: positioning a spacer element behind a front face portion of the shell and interconnecting the reinforcing brace and the spacer element with a bridge member.

6. The method of claim 1, further comprising: positioning a further one of the outwardly projecting edge portions of the second liner along a first recessed ledge portion of the base member.

7. The method of claim 6, further comprising: arranging a base cover against a second recessed ledge portion of the base member, with the base cover extending over the further one of the outwardly projecting edge portions of the second liner and along the base member.

8. The method of claim 1, further comprising: mounting the base member through a pair of attachment brackets interconnecting the base member with the upstanding side walls.

9. The method of claim 8, further comprising:

creating a gap between the shell and the base member; and positioning an end portion of a base cover in the gap.

10. The method of claim 9, further comprising: reinforcing the base member with a reinforcing brace secured to a rear surface portion of the base member.

11. The method of claim 10, further comprising: positioning a spacer along an inside front edge portion of the shell and interconnecting the reinforcing brace with the spacer through a bridge member.

12. The method of claim 1, further comprising: interconnecting the mullion bar between the upstanding side walls of the shell at a position spaced above and substantially parallel to the base member.

* * * * *